United States Patent [19]

Clipp et al.

[11] Patent Number: 4,505,070

[45] Date of Patent: Mar. 19, 1985

[54] WINDOW BLIND

[75] Inventors: James L. Clipp, 69286 Garver Lake Rd., Edwardsburg, Mich. 49112; Charles E. Stephens, Niles, Mich.

[73] Assignee: James L. Clipp, Elkhart, Ind.

[21] Appl. No.: 536,682

[22] Filed: Sep. 28, 1983

[51] Int. Cl.[3] ..... E06B 7/096

[52] U.S. Cl. ..... 49/83; 49/64; 49/84; 49/85; 49/465

[58] Field of Search ..... 49/84, 83, 82, 85, 465, 49/64, 51, 74; 160/178 B, 178

[56] References Cited

U.S. PATENT DOCUMENTS

| | | | |
|---|---|---|---|
| 390,392 | 10/1888 | Niss, Jr. | 160/178 B |
| 1,904,110 | 4/1933 | Willmann | 49/465 X |
| 2,234,712 | 3/1941 | Swanfeldt | 49/84 X |
| 2,349,470 | 5/1944 | Stanfield | 49/51 X |
| 2,952,885 | 9/1960 | Richardson | 49/85 |
| 3,460,289 | 8/1969 | Toth | 49/83 X |

FOREIGN PATENT DOCUMENTS

| | | | |
|---|---|---|---|
| 742840 | 1/1956 | United Kingdom | 49/64 |

*Primary Examiner*—Philip C. Kannan

*Attorney, Agent, or Firm*—Marmaduke A. Hobbs

[57] ABSTRACT

A window blind for controlling the amount of light admitted through a window, door, skylight, or the like. The blind is secured at the top and bottom of the window, making it suitable for use with all types of windows in buildings or vehicles, regardless of the relative orientation of the window with respect to the base of the structure or vehicle. The blinds have a plurality of horizontal slats, sequentially arranged in vertical alignment, and gear driven elements for supporting and adjusting the position of the slats.

5 Claims, 8 Drawing Figures

WINDOW BLIND

BACKGROUND OF THE INVENTION

Slatted window blinds have been used for many years for controlling the amount of light admitted through a window, door, skylight, or the like. The blinds are normally secured at the top of the window and have a plurality of thin, horizontal slats which are sequentially arranged, one above the other, in vertical alignment. In their fully closed position, the salts are disposed substantially parallel to the window, with each horizontal edge of a particular slat slightly overlapping the edge of the slat above and below for admitting little or no light. In their fully open position, the slats are normally disposed perpendicular to the window for admitting the maximum amount of light possible. In addition, the slats are selectively adjustable to any of the various angular positions between the two extremes, depending on the amount of light desired. The angle of the salts also determines the direction given the light admitted, and whether or not one inside the structure or vehicle can see outside, and whether or not one outside the structure or vehicle can see inside. Since most blinds are secured only at the top of the window, the entire blind can also normally be raised for opening or cleaning the window.

Normally, the slats are supported by and moved with cords or strips of fabric which push or pull on the edges of the slats to cause adjustment in their relative angle. The cords or fabric strips are controlled with hanging cords or wands, which are pulled or turned to adjust the slats. The blinds may be rendered inoperable, since the cords or fabric strips are subject to breaking from excessive force used in making adjustments and to deterioration from moisture, exposure to the sun, or to freezing temperatures. In addition, the hanging cords or wands used for making adjustments pose an attractive nuisance for children, which may result in the destruction of the cords, wands or individual slats, or in the entire blind being ripped from its mounting in the window. Greater problems, in addition to those mentioned above, are encountered where blinds are used in vehicles, especially since conventional blinds are secured only at the top of the window. The motion of the vehicle causes the hanging cords or wands, and the blinds themselves, to swing back and forth, bumping against the windows or the passengers, resulting in annoying and distracting noises, and possibly injury to the passengers. In addition, the design of conventional blinds, being secured at the top only, prevents their use in a skylight or other window which is not substantially perpendicular to the base of the structure or vehicle. While the blinds may also be secured at the bottom, the flexible nature of the blinds permits them to sway toward and away from the windows.

SUMMARY OF THE INVENTION

It is, therefore, one of the principal objects of the present invention to provide a window blind in which the individual slats are opened and closed by gear-driven support members, thereby eliminating the conventional cords or fabric strips and their associated disadvantages.

Another object of the present invention is to provide a window blind in which the support members and their attached slats are controlled by an integrated mechanism, thereby eliminating the conventional adjusting cords or wands which are susceptible to damage, and in which are no freely hanging elements to swing against the windows or passengers in a vehicle.

A further object of the present invention is to provide a blind which is secured at the top and bottom of the window, thereby eliminating any swinging of the blind itself, and making the present invention suitable for use with any window, door, skylight, or the like, regardless of the relative orientation of the particular window or the like to be shielded, and which can be quickly and easily removed for cleaning the window or the blind.

A still further object of the present invention is to provide a blind in which there are no parts subject to deterioration by moisture, sunlight, heat, or freezing temperatures, which is durable to provide a long service life, and in which substantially rigid members are used to support the slats, thereby eliminating or minimizing swaying of the blind in the wind or by motion of the vehicle in which it is installed.

These and other objects are attained by the present invention, which relates to a window blind for controlling the amount of light admitted through a window or the like, having a plurality of thin horizontal slats sequentially arranged, one above the other, in vertical alignment. The slats are selectively adjustable to positions substantially parallel with the window for admitting little or no light, positions substantially perpendicular to the window for maximum exposure, and any of the various angular positions therebetween for partial shading as desired. The blind has substantially rigid vertical members with support elements pivotally secured thereto for supporting the slats, and means are provided for adjusting the position of the slats.

Various other objects and advantages of the present invention will become apparent from the following description with reference to the accompanying drawings.

DETAILED DESCRIPTION OF THE PREFERRED EMBODIMENT

Figure 1:
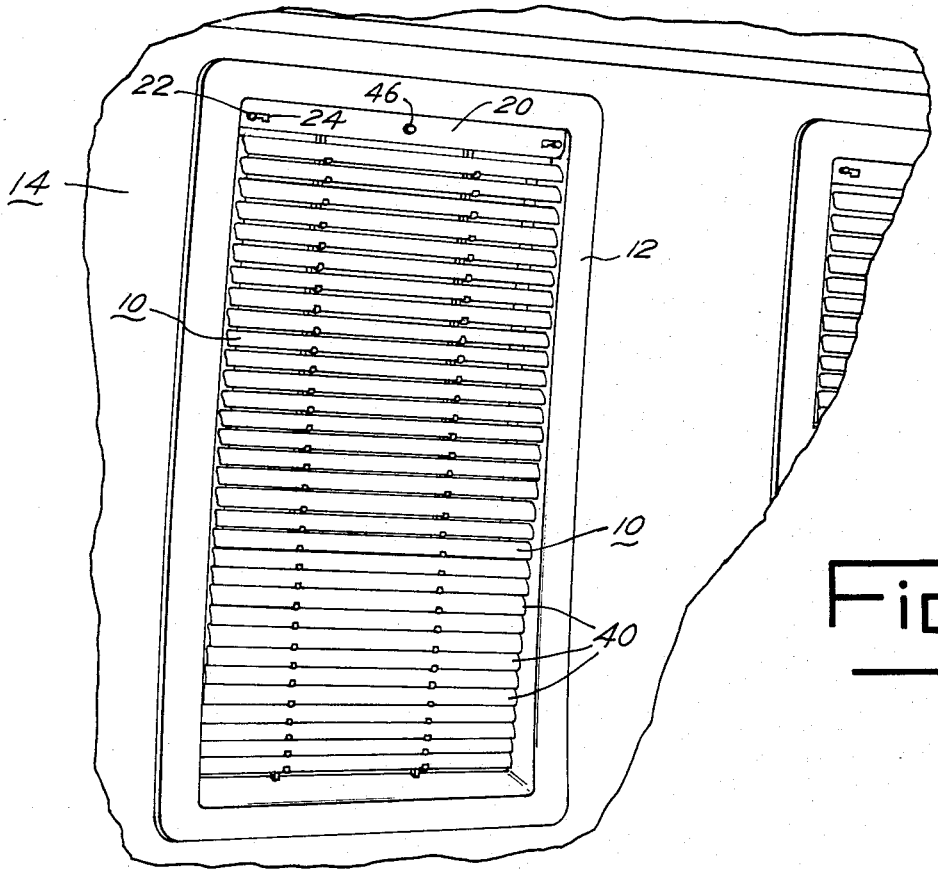
FIG. 1 is a perspective view of the window blind embodying the present invention, shown here installed in the frame of a window in the side of a van or similar vehicle.
Figure 2:
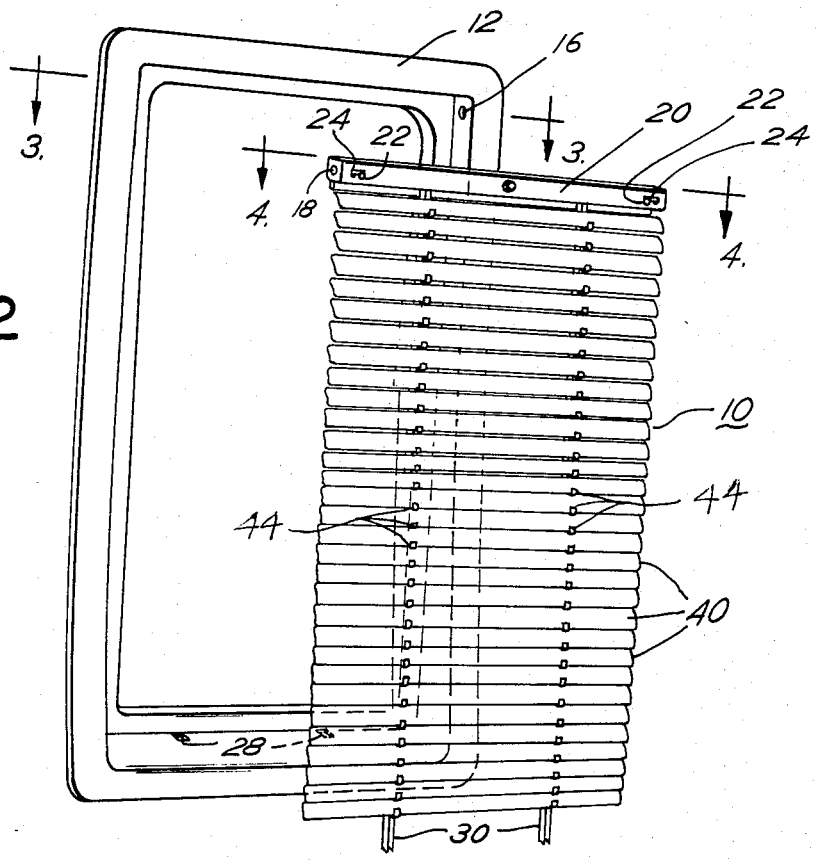
FIG. 2 is a perspective view of the window blind similar to that shown in the preceding figure, shown here apart from its installed position in the window frame.
Figure 3:
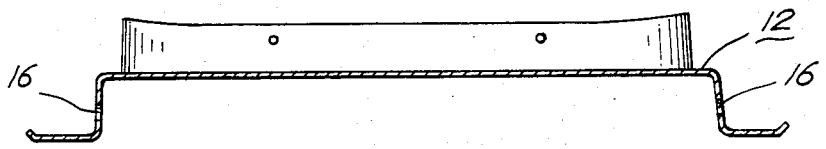
FIG. 3 is a cross-sectional view of the window frame adapted to receive the window blind embodying the present invention, the section being taken on line 3—3 of FIG. 2.
Figure 4:
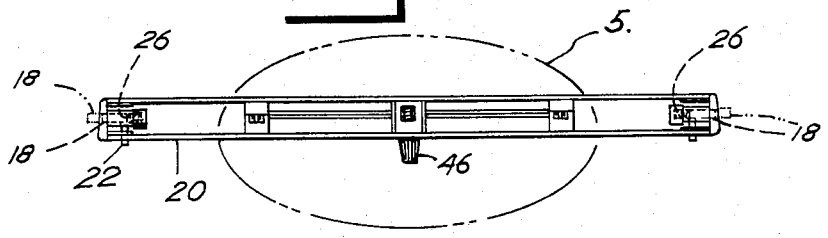
FIG. 4 is a top plan view showing the top of the window blind and the adjustment mechanism therein, the view being taken on line 4—4 of FIG. 2.
Figure 5:
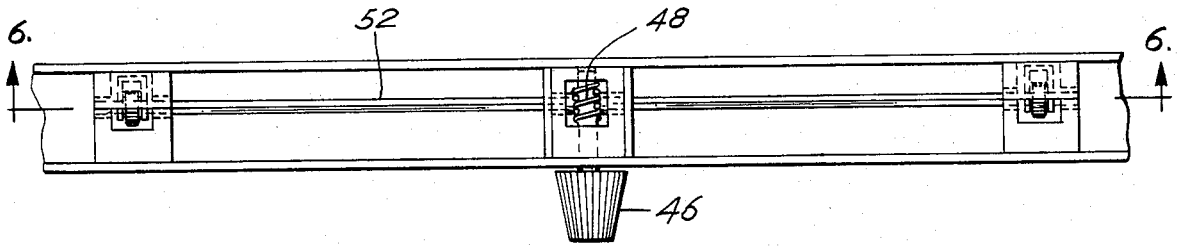
FIG. 5 is an enlarged, fragmentary top plan view similar to that shown in the preceding figure, the enlargement taken from circle 5 in FIG. 4.
Figure 6:
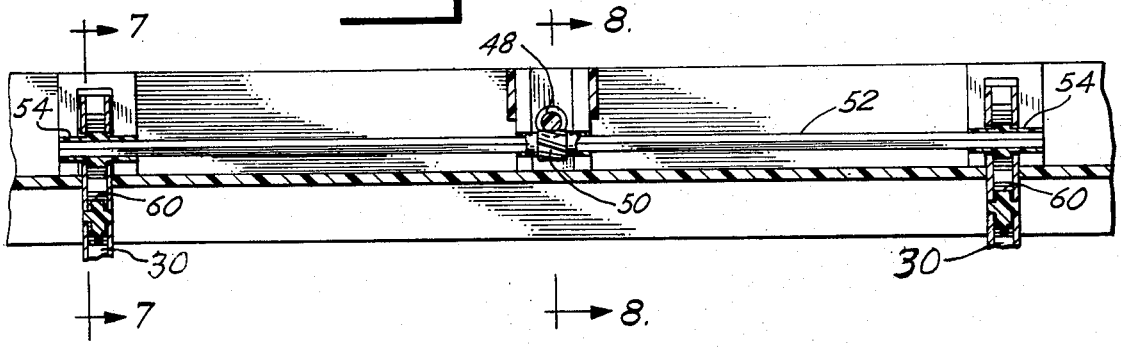
FIG. 6 is a cross-sectional view detailing features of the adjustment mechanism of the present invention, the view being taken on line 6—6 of FIG. 5.

Referring more specifically to the drawings, and to FIG. 1 in particular, numeral 10 designates generally the window blind embodying the present invention, shown here installed in a window frame 12 in the side of a van wall 14. The present invention can be used with all types of windows, doors, skylights, and the like, regardless of their relative orientation with respect to the base of the structure or vehicle, although for convenience of description, the blind will be described in the specification and set forth in the claims as being in vertical position.

Window frame 12 is provided with holes 16, one in each side near its upper end, for receiving lugs or pins 18 to secure the top of the blind 10 in the window frame. The pins are resiliently mounted and normally protrude laterally from a housing 20 at the top of the blind. The pins have handles 22 which protrude through inverted L-shaped openings 24 in the front surface of housing 20. When inserting or removing the blind from the window frame, the pins are retracted inwardly by moving the handles toward the center of housing 20 along the horizontally disposed areas of the L-shaped openings 24. The pins can be locked in a retracted position by moving the handles downwardly into the vertically disposed areas of the L-shaped openings where they are retained by the walls of housing 20. For releasing the pins to secure the blind in the window frame, the handles are moved upwardly into the horizontal areas where resilient members, such as spring 26, urge the pins into holes 16. Also provided in window frame 12 are slots 28 in the bottom of the frame for receiving vertical support members or channeled posts 30 for supporting the slats and securing the bottom of the blind in the frame. To insert the blind in the frame, the posts 30 are first inserted into slots 28 and the pins 18 are then inserted into holes 16. Removing the blind, for cleaning either it or the window, requires a reversal of the above mentioned steps. Since the blind has securing means at the top and the bottom, it can be used with all types of windows, such as skylights in the roof of a structure or vehicle, regardless of the relative orientation of the skylight or window. The top and bottom securing means also prevent the blind from swinging back and forth in response to the motion of a vehicle, eliminating the bumping against windows or passengers encountered with conventional blinds.

Figure 7:
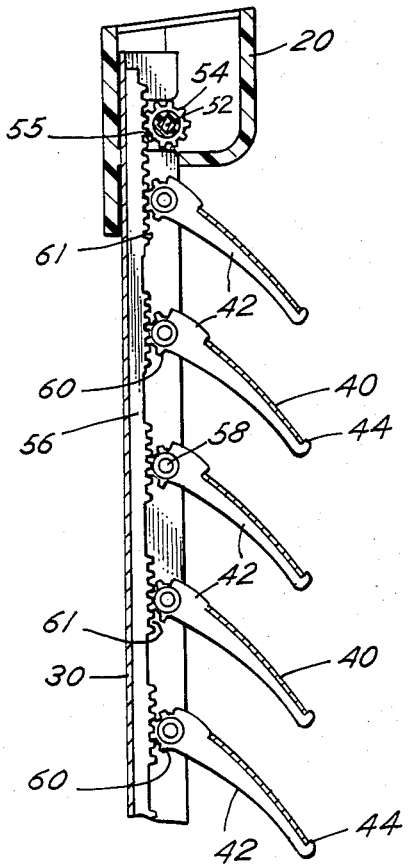
FIG. 7 is a fragmentary cross-sectional view detailing additional features of the adjustment mechanism and the support members used for supporting and moving the slats, the view being taken on line 7—7 of FIG. 6.
Figure 8:
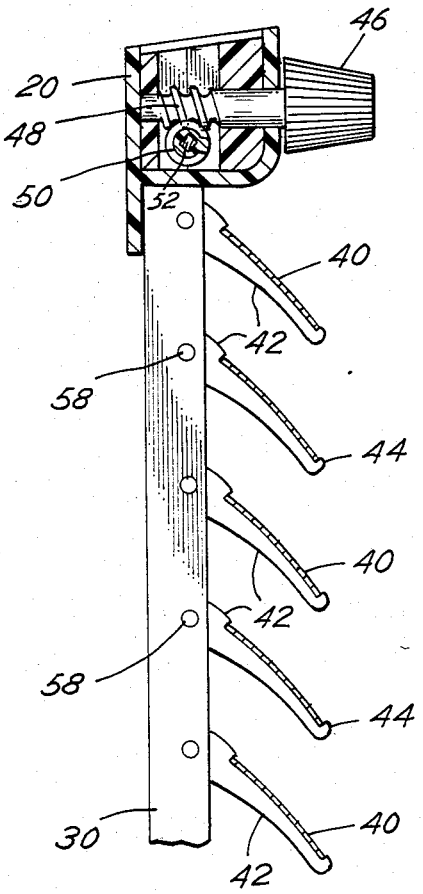
FIG. 8 is a fragmentary cross-sectional view detailing the adjustment mechanism of the present invention, the view being taken on line 8—8 of FIG. 6.

The blind 10 has a plurality of thin, horizontally disposed slats 40, sequentially arranged, one above the other in vertical alignment. The slats can be of any suitable material, such as aluminum, and are selectively positioned substantially parallel with the window, with the adjacent edges of the slats slightly overlapping for admitting little or no light, positioned substantially perpendicular to the window for full lighting, and in any of the various angular positions between the two extremes for partial shading. The slats are supported by a plurality of regularly spaced support elements or fingers 42, shown in FIGS. 7 and 8. In the embodiment shown, each slat is supported by two fingers; however, any number may be used, depending on the length of the slats. Fingers 42 are formed with recesses in their upper surface for receiving the slats 40, and the outer ends 44 of the fingers terminate in a hook-like configuration, further securing the slats in place.

Adjustments in the position of the slats are made by rotating an adjustment knob or handle 46. The knob is secured to and turns a worm gear 48, disposed in housing 20. The teeth of the worm gear engage a worm wheel 50, disposed directly beneath the worm gear. The worm wheel is disposed around an elongated bar 52 which extends laterally in both directions from the worm wheel and rotates therewith as the adjusting knob and worm gear are turned. Disposed around bar 52 at each end thereof are gear wheels 54, which are also mounted for rotation with the bar. The teeth 55 of the gear wheels 54 engage toothed gear strips 56, which extend vertically in the channels of posts 30. The gear strips are slidably mounted inside the posts, with the teeth 61 facing outwardly, and are raised or lowered by the engagement of the teeth of the gear wheels 54 with the teeth of the strip as the gear wheels turn.

The fingers 42 are mounted in spaced relation in the channels of posts 30, pivotally secured therein by pins 58. The ends of the fingers opposite the hooked ends 44 are formed as semicircular gear wheels 60. The teeth of the semicircular gear wheels mesh with gear segments 61 of gear strip 56 and are designed to move the fingers in a direction opposite that taken by the gear strip. Thus, from the partially open position shown in FIGS. 7 and 8, as the gear strip is moved upwardly, the fingers pivot downwardly, moving the slats toward a closed position.

In the use and operation of the window blind embodying the present invention, the blind is suitably mounted in a window frame in front of a window. The blind is secured at the top and bottom, a preferred embodiment being shown herein where posts 30 are inserted into slots 28 in the bottom of the window frame and pins 18 are inserted into holes 16 near the top of the frame, urged into engagement with the holes by springs 26. The orientation of the slats relative to the window is adjusted by rotating adjustment knob or handle 46, the knob turning worm gear 48, the teeth of which turn worm wheel 50. Rotation of the worm wheel causes bar 52 to rotate, along with gear wheels 54, which are mounted one on each end of the bar. The teeth of the gear wheels engage toothed gear strips 56, which are mounted for vertical sliding movement in the channels of posts 30. Turning the adjustment knob clockwise causes the gear wheels to rotate clockwise, as viewed in FIG. 8, thereby raising the gear strips. As the gear strips are raised, the teeth of semi-circular gear wheels 60, which engage the teeth 61 of the gear strips, cause fingers 42 to pivot downwardly from the positions shown in FIGS. 7 and 8, thereby closing slats 40. Rotation of the adjustment knob counter-clockwise causes the gear wheels to rotate counter-clockwise, thereby moving the gear strips downwardly, causing the fingers to pivot upwardly, and thereby opening the blind.

While one embodiment of a window blind has been shown and described in detail herein, various changes and modifications may be made without departing from the scope of the present invention.

I claim:

1. A window blind, having a window side and a room side, for controlling the amount of light admitted through a window or the like, comprising a plurality of horizontal slats on the room side of said blind, sequentially arranged in vertical alignment and selectively adjustable to positions substantially parallel with the window, positions substantially perpendicular to the window, and any of the various angular positions therebetween, relatively rigid vertical members having support elements pivotally secured thereto for supporting said salts and including vertically disposed channeled posts spaced apart at regular intervals and having toothed gear strips slidably mounted in the channel in the posts for vertical movement therein, and gear segments on said support elements meshing with teeth on the respective strip for positioning said slats, an elongated housing disposed at the top of said slats and parallel therewith, and means disposed in said housing for adjusting the position of said slats, including a rotatable adjustment handle projecting from said housing on the room side thereof, a worm gear secured to said handle for rotation therewith, a rotatable elongated bar parallel with said slats, a rotatable worm wheel engaging said worm gear and being disposed on said rotatable elongated bar, and gear wheels mounted on said bar for engaging said toothed gear strips and selectively moving said strips upwardly and downwardly upon rotation of said adjustment handle.

2. A window blind as defined in claim 10 in which said support elements have semicircular gear wheels on one end thereof for engaging said toothed gear strips.

3. A Venetian blind as defined in claim 1 in which said support elements include a plurality of regularly spaced fingers having recessed portions in the upper surface thereof for receiving said salts, the ends of said fingers opposite the outer ends being formed into semicircular gear wheels meshing with said toothed gear strips.

4. A venetian blind as defined in claim 1 in which said blind is secured to a window frame, said frame having slots formed in the lower part thereof for receiving said vertical members for securing the bottom of said blind.

5. A window blind as defined in claim 4 in which said blind includes resiliently mounted pins projecting laterally therefrom and being retractable to positions substantially flush with the ends of said housing, and said frame includes holes in the upper part thereof for receiving said pins and securing the top of said blind.

* * * * *